US006720032B1

(12) United States Patent
Kuhm et al.

(10) Patent No.: US 6,720,032 B1
(45) Date of Patent: Apr. 13, 2004

(54) PRETREATMENT BEFORE PAINTING OF COMPOSITE METAL STRUCTURES CONTAINING ALUMINUM PORTIONS

(75) Inventors: Peter Kuhm, Hilden (DE); Michael L. Sienkowski, Warren, MI (US); Gerald J. Cormier, Oxford, MI (US); Matthias Hamacher, Hurth (DE); Jurgen Geke, Dusseldorf (DE); Volkhard Enke, Leverkusen (DE); Jan-Willem Brouwer, Willich (DE); Hubert Venschott, Pforzheim (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/508,402

(22) PCT Filed: Sep. 4, 1998

(86) PCT No.: PCT/US98/18001

§ 371 (c)(1),
(2), (4) Date: Mar. 10, 2000

(87) PCT Pub. No.: WO99/12661

PCT Pub. Date: Mar. 18, 1999

Related U.S. Application Data

(60) Provisional application No. 60/058,481, filed on Sep. 10, 1997.

(51) Int. Cl.[7] ..... B05D 3/02

(52) U.S. Cl. ..... 427/327; 427/388.5; 427/435; 427/354; 148/251; 148/253

(58) Field of Search ..... 148/251, 253; 427/327, 388.5, 435, 354

(56) References Cited

U.S. PATENT DOCUMENTS

| | | | | |
|---|---|---|---|---|
| 3,912,548 | A | 10/1975 | Faigen | 148/6.15 R |
| 4,148,670 | A | 4/1979 | Kelly | 148/6.15 R |
| 4,376,000 | A | 3/1983 | Lindert | 148/6.15 R |
| 4,433,015 | A | 2/1984 | Lindert | 427/388.4 |
| 4,961,794 | A | 10/1990 | Miyamoto et al. | |
| 4,992,116 | A | 2/1991 | Hallman | 148/247 |
| 5,068,299 | A | 11/1991 | Lindert et al. | |
| 5,073,196 | A | 12/1991 | Fotinos et al. | |
| 5,129,967 | A | 7/1992 | Sander et al. | 148/247 |
| 5,211,769 | A | 5/1993 | Sobata et al. | |
| 5,268,041 | A | 12/1993 | Gehmecker et al. | 148/260 |
| 5,298,289 | A | 3/1994 | Lindert et al. | 427/388.4 |
| 5,308,413 | A | 5/1994 | Sobata et al. | |
| 5,449,415 | A | 9/1995 | Dolan | |
| 5,584,946 | A | 12/1996 | Karmaschek et al. | |
| 5,662,746 | A | 9/1997 | Affinito | |
| 5,851,371 | A | 12/1998 | Steinbrecher et al. | |

FOREIGN PATENT DOCUMENTS

| | | |
|---|---|---|
| DE | 2 433704 | 1/1975 |
| DE | 1 933013 | 12/1977 |
| DE | 3 146265 | 6/1982 |
| DE | 2 715292 | 12/1987 |
| DE | 4 210513 | 10/1993 |
| DE | 19 500927 | 7/1996 |
| DE | 19 538778 | 4/1997 |
| DE | 19 606017 | 8/1997 |
| DE | 19 735314 | 3/1998 |
| EP | 0 008942 | 3/1980 |
| EP | 0 091166 | 10/1983 |
| EP | 0 315059 | 5/1989 |
| EP | 0 319016 | 6/1989 |
| EP | 0 319017 | 6/1989 |
| EP | 0 452638 | 10/1991 |
| EP | 0 459541 | 12/1991 |
| WO | 90 12902 | 11/1990 |
| WO | 92 07973 | 5/1992 |
| WO | 93 03198 | 2/1993 |

*Primary Examiner*—Peter D. Mulcahy
(74) *Attorney, Agent, or Firm*—Stephen D. Harper; Mary K. Cameron

(57) ABSTRACT

In a process for the chemical pretreatment before painting of composite metal structures that contain aluminum or aluminum alloy portions together with steel, galvanized steel and/or alloy-galvanized steel portions, in a first step the metal structure is treated with a zinc phosphating solution that forms a surface-covering crystalline zinc phosphate layer on steel and on galvanized or alloy-galvanized steel, but without forming a zinc phosphate layer on the aluminum portions, and then in a second step the metal structure is brought into contact with a treatment solution that does not excessively dissolve the crystalline zinc phosphate layer on steel, galvanized and/or alloy-galvanized steel, but forms a conversion layer on the aluminum portions.

22 Claims, No Drawings

PRETREATMENT BEFORE PAINTING OF COMPOSITE METAL STRUCTURES CONTAINING ALUMINUM PORTIONS

This application claims the benefit of provisional application No. 60/058,481 filed Sep. 10, 1997.

BACKGROUND OF THE INVENTION

For many reasons, such as weight, rigidity or recyclability, aluminum is increasingly used in vehicle construction. In the context of this invention the expression "aluminum" refers not only to pure aluminum but also to aluminum alloys whose main component is aluminum. Examples of commonly used alloying elements are silicon, magnesium, copper, manganese, chromium and nickel, the total proportion by weight of these alloying elements in the alloy normally not exceeding 10%. Whereas engine and gear parts, wheels, seat frames, etc. already contain large amounts of aluminum, the use of aluminum in bodywork construction is presently still restricted to parts such as hoods, rear trunk lids, inner door parts and various small parts as well as truck cabins, side walls of transporters or attachments to minivans. Overall, worldwide less than 5% of the metal surface of automobile bodies is made of aluminum. The increased use of aluminum in this sector is being intensively investigated by the aluminum and automobile industries.

This invention relates to a process for the corrosion-prevention pretreatment before painting of composite metal structures that contain aluminum and/or aluminum alloy portions in addition to steel and/or galvanized steel portions. The process is particularly intended for use in automobile manufacturing. In automobile manufacturing, car bodies or car body parts that contain structural portions of aluminum and/or its alloys in addition to structural portions of steel and/or galvanized steel are subjected to a conversion-chemical pretreatment before they are painted. In this connection a cathodic electro-dip-coating is conventionally used at the present time as the first painting stage. The process according to the invention is particularly suitable as a pretreatment for this stage.

The process differs from previous conventional pretreatment processes in automobile manufacturing in that a surface-covering zinc phosphate layer is deposited in a first step on the steel and/or galvanized steel surfaces, without coating the aluminum surfaces to any appreciable extent. A second step comprises a treatment with a solution that does not excessively attack the previously formed zinc phosphate layer, and indeed preferably even enhances its corrosion-prevention action, and which simultaneously forms a surface layer on the aluminum surfaces.

A two-stage process is thus involved, whose first stage comprises a conventional zinc phosphating. It is a necessary condition, of course, that a zinc phosphating solution is used that does not form a layer on aluminum. Such zinc phosphating solutions are known in the prior art and are referred to by the way of example hereinafter. In the second stage solutions with constituents that are effective to form a protective layer on aluminum are used. In this connection the nature and concentration of these solutions should be chosen so that on the one hand a layer is reliably formed on the aluminum surfaces, but on the other hand the crystalline zinc phosphation layers formed on the iron and/or zinc surfaces are not excessively damaged.

The aim of phosphating metals is to produce firmly adhering metal phosphate layers on the metal surface that per se already improve the corrosion resistance, and in conjunction with paints or other organic coatings contribute to a substantial improvement of the coating adhesion and resistance to creepage under corrosive stress. Such phosphating processes have been known for a long time. For the pretreatment before painting, especially before electrodipcoating, low zinc phosphating processes, in which the phosphating solutions contain relatively small concentrations of zinc ions, for example 0.5 to 2 grams per liter, hereinafter usually abbreviated as "g/l", are particularly suitable. A basic parameter in these low zinc phosphating baths is the weight ratio of phosphate ions to zinc ions, which is normally above 8 and may reach values of up to 30.

It has been found that phosphate layers with substantially improved corrosion-prevention and paint adhesion properties can be formed by the co-use of other polyvalent cations in the zinc phosphating baths. For example, low zinc processes with the addition of, e.g., 0.5 to 1.5 g/l of manganese ions and, e.g., 0.3 to 2.0 g/l of nickel ions are widely used as so-called "tri-cation" processes for preparing metal surfaces for painting, for example for cathodic electrodipcoating of car bodies.

Since nickel and its alternative cobalt also are classed as hazardous from the toxicological and effluent treatment aspects, efforts are being made at the present time to find phosphating processes that are just as effective as the tri-cation processes but employ significantly lower bath concentrations of nickel and/or cobalt and preferably even dispense with these two metals altogether.

EP-A-459 541 describes phosphating solutions that are essentially free of nickel and that contain, in addition to zinc and phosphate, 0.2 to 4 g/l of manganese and 1 to 30 milligrams per liter, hereinafter usually abbreviated as "mg/l", of copper. From DE-A-42 10 513 nickel-free phosphating solutions are known that contain, in addition to zinc and phosphate, 0.5 to 25 mg/l of copper ions as well as hydroxylamine as accelerator. These phosphating solutions optionally also contain 0.15 to 5 g/l of manganese.

German patent application DE 196 06 017.6 describes a phosphating solution, with a decreased heavy metal concentration, which contains 0.2 to 3 g/l of zinc ions, 1 to 150 mg/l of manganese ions, and 1 to 30 mg/l of copper ions. This phosphating solution may optionally contain up to 50 mg/l of nickel ions and up to 100 mg/l of cobalt ions. A further optional constituent is lithium ions in amounts of between 0.2 and 1.5 g/l.

DE 195 38 778 describes controlling the coating weight of phosphate layers by the use of hydroxylamine as accelerator. The use of hydroxylamine and/or its compounds in order to influence the form of the phosphate crystals is known from a number of publications. EP-A-315 059 discloses as a special effect of the use of hydroxylamine in phosphating baths the fact that on steel the phosphate crystals still occur in the desired columnar or nodular form, even if the zinc concentration in the phosphating bath exceeds the conventional range for low zinc processes. In this way it is possible to operate the phosphating baths with zinc concentrations up to 2 g/l and with weight ratios of phosphate to zinc of as low as 3.7. The required hydroxylamine concentration is given as 0.5 to 50 g/l, preferably 1 to 10 g/l.

WO 93/03198 discloses the use of hydroxylamine as accelerator in tri-cation phosphating baths with zinc contents of between 0.5 and 2 g/l and nickel and manganese contents of in each case 0.2 to 1.5 g/l, specific weight ratios of zinc to the other divalent cations having to be maintained. In addition, these baths contain 1 to 2.5 g/l of a "hydroxylamine accelerator", which according to the description denotes salts of hydroxylamine, preferably hydroxylamine ammonium sulfate.

In order to improve the corrosion prevention produced by the phosphate layer, a so-called passivating post-rinsing, also termed post-passivation, is generally employed in this technology. Treatment baths containing chromic acid are still widely used for this purpose. For reasons of work safety and environmental protection there is a tendency, however, to replace these chromium-containing passivating baths by chromium-free treatment baths. Organo-reactive bath solutions containing complexing substituted poly(vinylphenols) are known for this purpose. Examples of such compounds are described in DE-C-31 46 265. Particularly effective polymers of this type contain amine substituents and may be obtained by a Mannich reaction between poly(vinylphenols) and aldehydes and organic amines. Such polymers are described for example in EP-B-91 166, EP-B-319 016 and EP-B-319 017. Polymers of this type are also used within the scope of the present invention, and accordingly the contents of the immediately aforementioned four documents, except to any extent that may be inconsistent with any explicit teaching herein, are hereby incorporated herein by reference. The use of such polyvinyl phenol derivatives for the surface treatment of aluminum is known, for example, from the aforementioned EP-B-319 016.

WO 90/12902 discloses a chromium-free coating for aluminum, the aluminum surfaces being contacted with a treatment solution that has a pH in the range from about 2.5 to about 5.0 and contains, in addition to polyvinyl phenol derivatives, also phosphate ions as well as fluoro acids of the elements zirconium, titanium, hafnium and silicon.

U.S. Pat. No. 5,129,967 discloses treatment baths for a no-rinse treatment (termed there as "dried in place conversion coating") of aluminum, containing:

(a) 10 to 16 g/l of polyacrylic acid or copolymers of acrylic acid, (b) 12 to 19 g/l of hexafluorozirconic acid, (c) 0.17 to 0.3 g/l of hydrofluoric acid, and (d) up to 0.6 g/l of hexafluorotitanic acid.

EP-B-8 942 discloses treatment solutions, preferably for aluminum cans, containing:

(a) 0.5 to 10 g/l of polyacrylic acid or an ester thereof, (b) 0.2 to 8 g/l of at least one of the compounds $H_2ZrF_6$, $H_2TiF_6$ and $H_2SiF_6$, the pH of the solution being below 3.5, as well as an aqueous concentrate to replenish the treatment solution, containing:

(a) 25 to 100 g/l of polyacrylic acid or an ester thereof, (b) 25 to 100 g/l of at least one of the compounds $H_2ZrF_6$, $H_2TiF_6$ and $H_2SiF_6$, and (c) a source of free fluoride ions that yields 17 to 120 g/l of free fluoride.

DE-C-19 33 013 discloses treatment baths with a pH above 3.5, which besides complex fluorides of boron, titanium or zirconium in amounts of 0.1 to 15 g/l, measured as its stoichiometric equivalent as boron, titanium, or zirconium as appropriate, additionally contain 0.5 to 30 g/l of oxidizing agent, especially sodium meta-nitrobenzenesulfonate. DE-C-24 33 704 describes treatment baths to improve paint adhesion and permanent corrosion prevention on, inter alia, aluminum, which may contain 0.1 to 5 g/l of polyacrylic acid or its salts or esters as well as 0.1 to 3.5 g/l of ammonium fluorozirconate, calculated as $ZrO_2$. The pH of these baths may vary over a wide range. The best results are generally obtained when the pH is between 6 and 8. U.S. Pat. No. 4,992,116 describes treatment baths for the conversion treatment of aluminum with pH values between about 2.5 and 5, which contain at least three components:

(a) phosphate ions in the concentration range between $1.1\times10^{-5}$ to $5.3\times10^{-3}$ mole/l, corresponding to 1 to 500 mg/l, (b) $1.1\times10^{-5}$ to $1.3\times10^{-3}$ mole/liter, hereinafter usually abbreviated as "mole/l", of a fluoro acid of an element of the group Zr, Ti, Hf and Si (corresponding to 1.6 to 380 mg/l of each element) and (c) 0.26 to 20 g/l of a polyphenol compound obtainable by reacting poly(vinylphenol) with aldehydes and organic amines.

A molar ratio of fluoro acid to phosphate of about 2.5:1 to about 1:10 should be maintained.

DE-A-27 15 292 discloses treatment baths for the chromium-free pretreatment of aluminum cans, which contain at least 10 parts per million by weight, hereinafter usually abbreviated as "ppm", of titanium and/or zirconium, between 10 and 1000 ppm of phosphate, and a sufficient amount of fluoride, but at least 13 ppm, to form complex fluorides of the titanium and/or zirconium present, and have pH values of between 1.5 and 4.

WO 92/07973 discloses a chromium-free treatment process for aluminum, which uses as essential components in acid aqueous solution 0.01 to about 18 wt. % of $H_2ZrF_6$ and 0.01 to about 10 wt. % of a 3-(N-$C_{1-4}$alkyl-N-2-hydroxyethyl-aminomethyl)-4-hydroxy-styrene polymer. Optional components include 0.05–10 wt. % of dispersed $SiO_2$, 0.06 to 0.6 wt. % of a solubilizing agent for the polymer, as well as a surfactant. The aforementioned polymer is included among the "reaction products of poly(vinylphenol) with aldehydes and organic hydroxyl group-containing amines" described below and that can be used within the scope of the present invention.

In practice it has been found that in the joint phosphating of surfaces of aluminum and those of steel and/or galvanized steel, technical compromises have to be accepted as regards the composition of the phosphating baths. Aluminum ions released from the aluminum surface by the etching and pickling action act as a bath poison for the phosphating solution and interfere in the formation of zinc phosphate crystals on iron surfaces. The dissolved aluminum must therefore be precipitated or masked by appropriate measures. For this purpose free or complex-bound fluoride ions are normally added to the phosphating baths.

The fluoride ions mask the aluminum ions by complex formation and/or precipitate these ions as hexafluoroaluminates of sodium and/or potassium if the solubility products of the corresponding salts are exceeded. Furthermore free fluoride ions usually lead to an increased etching attack on the aluminum surfaces, with the result that a more or less closed and sealed zinc phosphate layer can form on the latter.

The joint phosphating of aluminum structural portions with those of steel and/or galvanized steel thus has the technical disadvantage that the phosphating baths have to be very accurately monitored as regards their fluoride content. This increases the control and monitoring work involved and may require stocking and metering fluoride-containing solutions as separate replenishment solutions. Also, the precipitated hexafluoroaluminate salts increase the amount of phosphating sludge and raise the cost of its removal and disposal.

Accordingly there exists a need for pretreatment processes for complex structural parts, for example automobile bodies, that contain besides aluminum portions, also steel and/or galvanized steel portions. The formulation range for the phosphating baths should be broadened and the control and monitoring work involved should be reduced. The result of the overall pretreatment should be the formation of a conversion layer on all exposed metal surfaces that is suitable as a corrosion-preventing paint substrate, especially before a cathodic electro-dipcoating.

SUMMARY OF THE INVENTION

This object is achieved by a process for the chemical pretreatment, before an organic coating, of composite metal structures that contain aluminum or aluminum alloy portions together with steel, galvanized steel and/or alloy-galvanized steel portions, characterized by:

(I) treating in a first step the composite metal structure with a zinc phosphating solution that forms on steel and on galvanized and/or alloy-galvanized steel a surface-covering crystalline zinc phosphate layer having a coating weight in the range from 0.5 to 5 g/m$^2$, but without forming a zinc phosphate layer on the aluminum portions;

and subsequently, with or without intermediate rinsing with water, (II) contacting in a second step the composite metal structure with a treatment solution that does not dissolve more than, with increasing preference in the order given, 60, 50, 40, 30, 20, 15, 10, 8, or 6% of the crystalline zinc phosphate layer formed on steel, galvanized and/or alloy-galvanized steel in step (I), but does produce a conversion layer on the aluminum portions.

The stipulation that no zinc phosphate layer is to be formed on the aluminum portions in the treatment step (a) is to be understood to mean that no closed and sealed crystalline layer is formed and that the mass per unit area of any deposited zinc phosphate does not exceed 0.5 grams per square meter, hereinafter usually abbreviated as "g/m$^2$". In order to satisfy this condition, the phosphating baths may be arbitrarily formulated as long as specific conditions for the fluoride concentration are observed. These conditions may be found in EP-B-452 638. This document summarizes the conditions under which a closed zinc phosphate layer is formed on aluminum surfaces. According to this disclosure the concentration of free fluoride ions for example, measured in g/l, should satisfy the condition that, at a specific temperature T (in ° C.), it lies above a value of 8/T. Since however within the scope of the present invention no zinc phosphate layer should be formed on aluminum in the phosphating step (I), in contrast to the teaching of EP-B-452 638, at a specific temperature T (in ° C.) the concentration of free fluoride ions (in g/l) in the phosphating solution must be below 8/T.

DETAILED DESCRIPTION OF THE INVENTION

Accordingly, in the phosphating step (I) a zinc phosphating solution which has a pH in the range from about 2.5 to about 3.6 and a temperature in the range from about to about 65° C., and which does not contain more free fluoride in g/l than is specified by the expression 8/T, "T" denoting the bath temperature in ° C., is preferably used. Independently for each component stated, this zinc phosphating solution preferably also comprises:

0.3 to 3 g/l of Zn(II), to 40 g/l of phosphate ions, and at least one of the following accelerators:

0.3 to 4, or more preferably 1 to 4, g/l of chlorate ions, 0.01 to 0.2 g/l of nitrite ions, 0.05 to 2, or more preferably 0.2 to 2, g/l of m-nitrobenzenesulfonate ions, 0.05 to 2 g/l of m-nitrobenzoate ions, 0.05 to 2 g/l of p-nitrophenol, 0.001 to 0.15, or more preferably 0.001 to 0.070, g/l of hydrogen peroxide in free or bound form, 0.1 to 10 g/l hydroxylamine in free or bound form, and 0.1 to 10 g/l of a reducing sugar.

Experience shows that the corrosion prevention and paint adhesion of the crystalline zinc phosphate layers formed in such a phosphating bath are improved if the zinc phosphating solution in step (I) additionally contains one or more of the following cation concentrations:

0.001 to 4 g/l of manganese(II), 0.001 to 4 g/l of nickel(II), 0.002 to 0.2 g/l of copper(II), 0.2 to 2.5 g/l of magnesium(II), 0.2 to 2.5 g/l of calcium(II), 0.01 to 0.5 g/l of iron(II), 0.2 to 1.5 g/l of lithium(I), and 0.02 to 0.8 g/l of tungsten(VI).

The zinc concentration is more preferably in the range between about 0.8 and about 1.6 g/l. Zinc concentrations above 1.6 g/l, for example between 2 and 3 g/l, bring only slight advantages for the process, but on the other hand can increase the incidence of sludge in the phosphating bath. Such zinc concentrations are adjusted in a working phosphating bath if during the phosphating of galvanized surfaces additional zinc passes into the phosphating bath through its etching action. Nickel and/or cobalt ions in a concentration range of in each case about 1 to about 50 mg/l for nickel and about 5 to about 100 mg/l for cobalt in combination with as low a nitrate content as possible, not more than about 0.5 g/l, improve the corrosion prevention and paint adhesion compared to phosphating baths that do not contain nickel or cobalt or that have a nitrate content of more than 0.5 g/l. In this way a favorable compromise is reached between the performance of the phosphating baths on the one hand and the requirements of the effluent technology treatment of the rinse waters on the other hand.

With phosphating baths containing reduced amounts of heavy metals, the manganese content may be in the range from about 0.001 to 0.2 g/l. Otherwise manganese contents of about 0.5 to about 1.5 g/l are conventional.

It is known from DE-A-195 00 927 that lithium ions in amounts of about 0.2 to about 1.5 g/l improve the corrosion prevention that can be achieved with zinc phosphating baths. Lithium concentrations in the range from 0.2 to about 1.5 g/l and in particular from about 0.4 to about 1 g/l also have a beneficial effect on the resultant corrosion prevention with the phosphating process according to the invention and subsequent post-treatment.

Apart from the aforementioned cations, which are incorporated into the phosphate layer or at least positively influence the crystal growth of the phosphate layer, the phosphating baths as a rule also contain sodium, potassium and/or ammonium ions to adjust the free acid. The term "free acid" is well known to those skilled in the art in the phosphating field. The method chosen to determine free acid as well as the total acid in this step is specified in the examples. Free acid and total acid represent an important control parameter for phosphating baths, since they have a large influence on the coating weight. Free acid values of between 0 and 1.5 points in parts phosphating, or up to 2.5 points in coil phosphating, and total acid values of between about 10, or for immersion phosphating preferably about 15, and about 30 points lie in the technically normal range and are suitable within the scope of this invention.

For the phosphating of zinc surfaces it would not be absolutely necessary for the phosphating baths to contain so-called accelerators. For phosphating steel surfaces it is, however, necessary for the phosphating solution to contain one or more accelerators. Such accelerators are conventionally used in the prior art as components of zinc phosphating baths. The term accelerators refers to substances that chemically react with the hydrogen produced on the metal surface by the etching action of the acid in such a way that they are themselves reduced. Oxidizing accelerators furthermore have the effect of oxidizing iron(II) ions released by the etching action on steel surfaces to the trivalent oxidation state, so that they can precipitate out as iron (III) phosphate.

In step (II), solutions according to the prior art that produce a conversion layer on aluminum may be used. These solutions must not, however, excessively dissolve the crystalline zinc phosphate layer formed in step (I). The pH of these solutions should therefore lie in the range from 2.5 to 10, preferably from 3.3 to 10. Advantageously in step (II) solutions are chosen containing components that additionally passivate the crystalline zinc phosphate layers. Such solutions are mentioned hereinafter by way of example. Within the scope of the process sequence according to the invention, in step (II) the metal structures are generally brought into contact with the treatment solutions by spraying or by dipping. The temperature of the treatment solution for step (II) is preferably chosen in the range from 20 to 70° C.

By way of example, in step (II) a treatment solution may be used that has a pH in the range from about 5 to about 5.5 and that contains overall about 0.3 to about 1.5 g/l of hexafluorotitanate and/or hexafluorozirconate ions. It may be advantageous for the corrosion protection of the crystalline zinc phosphate layer produced in step (I) if this treatment solution additionally contains about 0.01 to 0.1 g/l of copper ions for step (II).

Moreover, a treatment solution may be used in step (II) that has a pH in the range from 3.5 to 5.8 and that contains 10 to 500 mg/l of organic polymers chosen from poly-4-vinylphenol compounds of the immediately following general formula (I):

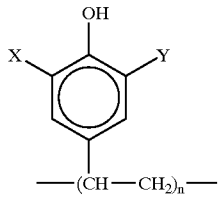

wherein n is an integer between 5 and 100, each of X and Y independently of each other denotes hydrogen or a $CRR^1OH$ moiety in which each of R and $R^1$ independently is hydrogen or an aliphatic or aromatic moiety with 1 to 12 carbon atoms.

For step (II) in particular those treatment solutions are preferred that contain polyvinylphenol derivatives according to the teaching of EP-B-319 016. This document also discloses the preparation of such polyvinylphenol derivatives. Accordingly, in step (II) a treatment solution is preferably used that has a pH in the range from 3.3 to 5.8 and contains 10 to 5000 mg/l of organic polymers selected from homopolymer or copolymer compounds containing amino groups, comprising at least one polymer selected from the group consisting of materials (α) and (β), wherein:

(α) consists of polymer molecules each of which has at least one unit conforming to the immediately following general formula (II):

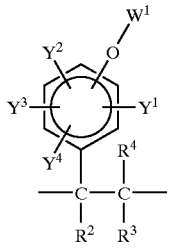

wherein:

each of $R^2$ through $R^4$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^1$ through $Y^4$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a $—CH_2Cl$ moiety; an alkyl moiety with from 1 to 18 carbon atoms; an aryl moiety with from 6 to 18 carbon atoms; a moiety conforming to the general formula $—CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

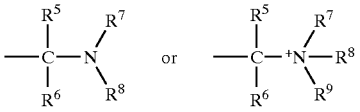

where each of $R^5$ through $R^8$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety, an aryl moiety, a hydroxyalkyl moiety, an aminoalkyl moiety, a mercaptoalkyl moiety, and a phosphoalkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphospho alkyl moiety, an $—O^-$ moiety, and an —OH moiety, at least one of $Y^1$ through $Y^4$ in at least one unit of each selected polymer molecule being a moiety Z as above defined; and $W^1$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkylbenzyl; halo or polyhalo alkyl, or halo or poly haloalkenyl moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety; and (β) consists of polymer molecules each of which does not include a unit conforming to general formula (II) as given above but does include at least one unit corresponding to the immediately following general formula (III):

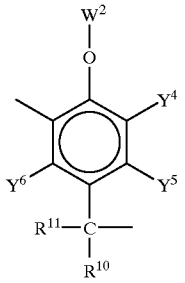

wherein:

each of $R^{10}$ and $R^{11}$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^4$ through $Y^6$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a —$CH_2Cl$ moiety; an alkyl moiety with from 1 to 18 carbon atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z as defined for material (α) above, at least one of $Y^1$ through $Y^4$ in at least one unit of each selected polymer molecule being a moiety Z as above defined; and $W^2$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkylbenzyl; halo or polyhalo alkyl, or halo or polyhalo alkenyl moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety;

the phrase "polymer molecule" in the above definitions of materials (α) and (β) including any electrically neutral molecule with a molecular weight of at least 300 daltons.

Ordinarily, primarily for reasons of economy, it is preferred to utilize as materials (α) and/or (β) predominantly molecules which consist entirely, except for relatively short end groups, of units conforming to one of the general formulas (I) and (II) as described above. Again primarily for reasons of economy, such materials are generally prepared by reacting homopolymers of p-vinyl phenol, for material (α), or phenol-aldehyde condensation products, for material (β), with formaldehyde and secondary amines to graft moieties Z on some of the activated benzene rings in the materials thus reacted.

However, in some particular instances, it may be more useful to utilize more chemically complex types of materials (α) and/or (β). For example, molecules formed by reacting a condensable form of a molecule belonging to component (α) or (β) as defined above, except that the molecule reacted need not initially satisfy the requirement for component (α) or (β) that each molecule contain at least one moiety Z, with at least one other distinct type of molecule which is selected from the group consisting of phenols, tannins, novolak resins, lignin compounds, aldehydes, ketones, and mixtures thereof, in order to prepare a condensation reaction product, which optionally if needed is then further reacted with (1) an aldehyde or ketone and (2) a secondary amine to introduce at least one moiety Z as above defined to each molecule, so that the molecule can qualify as material (α) or (β).

Another example of more complex materials that can be utilized as material (α) is material in which the polymer chains are at least predominantly copolymers of simple or substituted 4-vinyl phenol with another vinyl monomer such as acrylonitrile, methacrylonitrile, methyl acrylate, methyl methacrylate, vinyl acetate, vinyl methyl ketone, isopropenyl methyl ketone, acrylic acid, methacrylic acid, acrylamide, methacrylamide, n-amyl methacrylate, styrene, m-bromostyrene, p-bromostyrene, pyridine, diallyidimethyl-ammonium salts, 1,3-butadiene, n-butyl acrylate, t-butylamino-ethyl methacrylate, n-butyl methacrylate, t-butyl methacrylate, n-butyl vinyl ether, t-butyl vinyl ether, m-chlorostyrene, o-chlorostyrene, p-chlorostyrene, n-decyl methacrylate, N,N-diallylmelamine, N,N-di-n-butylacrylamide, di-n-butyl itaconate, di-n-butyl maleate, diethylaminoethyl methacrylate, diethylene glycol monovinyl ether, diethyl fumarate, diethyl itaconate, diethylvinyl phosphate, vinylphosphonic acid, diisobutyl maleate, diisopropyl itaconate, diisopropyl maleate, dimethyl fumarate, dimethyl itaconate, dimethyl maleate, di-n-nonyl fumarate, di-n-nonyl maleate, dioctyl fumarate, di-n-octyl itaconate, di-n-propyl itaconate, N-dodecyl vinyl ether, acidic ethyl fumarate, acidic ethyl maleate, ethyl acrylate, ethyl cinnamate, N-ethyl methacrylamide, ethyl methacrylate, ethyl vinyl ether, 5-ethyl-2-vinylpyridine, 5-ethyl-2-vinylpyridine-1-oxide, glycidyl acrylate, glycidyl methacrylate, n-hexyl methacrylate, 2-hydroxyethyl methacrylate, 2-hydroxypropyl methacrylate, isobutyl methacrylate, isobutyl vinyl ether, isoprene, isopropyl methacrylate, isopropyl vinyl ether, itaconic acid, lauryl methacrylate, methacrylamide, methacrylic acid, methacrylonitrile, N-methylolacrylamide, N-methylolmethacrylamide, N-isobutoxymethylacrylamide, N-isobutoxy-methylmethacrylamide, N-alkyloxy-methylacrylamide, N-alkyl-oxymethylmethacrylamide, N-vinylcaprolactam, methyl acrylate, N-methylmethacrylamide, α-methylstyrene, m-methylstyrene, o-methylstyrene, p-methylstyrene, 2-methyl-5-vinylpyridine, n-propyl methacrylate, sodium p-styrenesulfonate, stearyl methacrylate, styrene, p-styrenesulfonic acid, p-styrenesulfonamide, vinyl bromide, 9-vinyl carbazole, vinyl chloride, vinylidene chloride, 1-vinyinaphthalene, 2-vinyinaphthalene, 2-vinylpyridine, 4-vinylpyridine, 2-vinylpyridine N-oxide, 4-vinylpyrimidine, and N-vinylpyrrolidone.

The following preferences, primarily for reasons of economy, improved corrosion resistance, and/or increased water solubility, apply, independently for each preference, to the molecules of materials (α) and (β):

each of $R^2$ through $R^6$, $R^{10}$, $R^{11}$, $W^1$, and $W^2$, independently for each and from one unit to another in the same or a different molecule, preferably is a hydrogen moiety;

each of $Y^1$ through $Y^6$, independently for each and from one unit to another in the same or a different molecule, preferably is a hydrogen moiety or a moiety Z;

each polymer molecule contains a number of units corresponding to one of general formulas (II) and (III) as defined above that is at least, with increasing preference in the order given, 2, 3, 4, 5, 6, 7, or 8 and independently preferably is not more than 100, 75, 50, 40, 30, or 20, in the total of materials (α) and (β) in a composition used in step (II) according to the invention, the number of moieties Z has a ratio to the number of aromatic nuclei that is at least, with increasing preference in the order given, 0.01:1.0, 0.03:1.0, 0.05:1.0, 0.10:1.0, 0.20:1.0, 0.40:1.0, 0.50:1.0, 0.60:1.0, 0.70:1.0, 0.80:1.0, 0.90:1.0, or 0.95:1.0 and independently preferably is not more than, with increasing preference in the order given, 2.0:1.0, 1.6:1.0, 1.50:1.0, 1.40:1.0, 1.30:1.0, 1.20:1.0, 1.10:1.0, or 1.00:1.0; and in the total of materials (α) and (β) in a composition used in step (II) according to the invention, the number of "polyhydroxy moieties Z", which are defined as moieties Z in which at least one of $R^5$ through $R^8$ in the general formulas given above for moieties Z has (i) from 3 to 8, or preferably from 4 to 6, carbon atoms and (ii) as many hydroxyl groups, each attached to one of the carbon atoms, as one less than the number of carbon atoms in the $R^5$ through $R^8$ moiety, has a ratio to the total number of moieties Z in the composition that is at least, with increasing preference in the order given, 0.10:1.0, 0.20:1.0, 0.30:1.0, 0.40:1.0, 0.50:1.0, 0.60:1.0, 0.70:1.0, 0.80:1.0, 0.90:1.0, or 0.98:1.0 (preparation of such materials is described in the references cited above).

Poly(5-vinyl-2-hydroxy-N-benzyl)-N-methylglucamine is a specific polymer of the most preferred type, which, in the acidic pH range which is to be established, is present at least in part as an ammonium salt.

Solutions may be used that do not contain any further active constituents, apart from the polyvinyl phenol derivative and an acid for adjusting the pH, preferably phosphoric acid. Additions of further active constituents, in particular hexafluorotitanate or hexafluorozirconate ions, may however improve the layer formation on aluminum. For example, a solution may be used whose pH lies preferably in the range from about 3.3 to about 5.8 and which contains as organic polymer about 100 to about 5000 mg/l of an organic polymer in the form of a methylethanolamine derivative or N-methylglucamine derivative of polyvinyl phenol and in addition 10 to 2000 mg/l of phosphate ions, 10 to 2500 mg/l of hexafluorotitanate or hexafluorozirconate ions, and 10 to 1000 mg/l of manganese ions.

Instead of the polyvinyl phenol derivatives, whose preparation involves a certain expense, there may be used in step (II) solutions or dispersions of organic polymers selected from homopolymers and/or copolymers of acrylic acid and methacrylic acid as well as their esters. Preferably these solutions or dispersions have pH values in the range from about 3.3 to about 4.8 and contain about 250 to about 1500 mg/l of organic polymers. According to the teaching of EP-B-0 08 942 these polymer solutions or dispersions may additionally contain hexafluorotitanates, hexafluorozirconates and/or hexafluorosilicates.

EXAMPLES

A process sequence according to the invention was tested on sample metal sheets of cold rolled steel (hereinafter usually abbreviated as "CRS"), electrolytically galvanized steel (hereinafter usually abbreviated as "ZE"), electrolytically zinc-iron-coated steel (hereinafter usually abbreviated as "ZFE") and on aluminum 6111. As is conventional in the automobile manufacturing sector, these metal sheets were first of all cleaned with alkali and activated with an activating solution containing titanium phosphate. The sheets were then dipped for 3 minutes in a phosphating bath at a temperature of 48° C. having the following composition:

Zn=1.2 g/l

Mn=0.8 g/l

Ni=0.8 g/l $PO_4^{3-}$=18 g/l $NO_2$—=110 ppm

Residual cations=$Na^+$

Free acid 1.1

Sealed phosphate layers having coating weights in the region of 2 g/m$^2$ were deposited by this phosphating procedure on cold rolled steel, electrolytically galvanized steel and on electrolytically zinc-iron-coated steel. Scanning electron microscopy photographs showed that only widely-scattered zinc phosphate crystals had formed on the aluminum sheets.

As step (II) the sample sheets were treated with fully deionized water (comparison tests) as well as with solutions of one of the following compositions (a), (b), and (c). These solutions had a temperature of 25° C. and were sprayed for 30 seconds onto the sample sheets. The sheets were then sprayed for 15 seconds with fully deionized water and blown dry with compressed air at room temperature. For the corrosion prevention tests, they were coated with a triple layer paint structure, applied in the order shown: E-coat=PPG ED 5000, base coat=Dupont white 542 AB 839, Clear coat=Dupont RK 8010. The corrosion resistance tests were carried out according to the GM9540P-B process cycle of General Motors, which consists of the following steps:

1. (1.1) Spraying each panel with a salt spray solution (0.9 wt. % of table salt, 0.1 wt. % of calcium chloride, 0.25 wt. % of sodium bicarbonate, with the balance water) sufficiently to thoroughly wet the panel; (1.2) within 30 minutes after spraying the panel, inserting it into an atmosphere controlled to remain at 25° C. and 30–50% relative atmospheric humidity; (1.3) ninety minutes after beginning step (1.2), removing the panel from the controlled atmosphere in which it was kept during step (1.2), then repeating steps (1.1) and (1.2) three times each. Step 1 as a whole thus consumes 8 hours.
2. 8 hours' condensate water test at 49° C. and 95–100% relative atmospheric humidity;
3. 8 hours' dry storage at 60° C. and <30% relative atmospheric humidity;
4. At the week-end: only dry storage at 25° C. and 30–50% relative atmospheric humidity.

The steps 1 to 3 immediately above in each case form a cycle that is repeated Mondays through Fridays. Step 4 is not counted in the cycle number. The tests lasted for 40 cycles (5 cycles per week corresponding to a test time of 8 weeks).

Table 1 below shows the compositions of the three post-rinse solutions, and Tables 2 and 3 show the zinc phosphate coating etch amounts and the average paint creepages at the scribe (full scribe width) respectively.

TABLE 1

POST-RINSE COMPOSITIONS

| Ingredient | Amount of Ingredient in: Post-rinse soln.(a), pH 2.7 | Post-rinse soln.(b), pH 3.5 | Post-rinse soln.(c), pH 2.9 |
|---|---|---|---|
| Polymer* | 0.453 g/l | 0.451 g/l | 0.113 g/l |
| Phosphate | 0.957 g/l | 0.955 g/l | 0.239 g/l |
| Hexafluortitanate | 1 g/l | 1 g/l | 0.25 g/l |
| Mn(II) | 0.39 g/l | 0.39 g/l | 0.1 g/l |

*Poly(5-vinyl-2-hydroxy-N-benzyl)-N-methylglucamine

TABLE 2

ZINC PHOSPHATE COATING ETCHING LOSS VALUES

| Test Number | Substrate | Post-Rinse Solution | Coating Loss, Percent |
|---|---|---|---|
| Example 1 | CRS | (a) | 69 |
| Example 2 | CRS | (b) | 5 |
| Example 3 | CRS | (c) | 27 |
| Example 4 | ZE | (a) | 50 |
| Example 5 | ZE | (b) | 5 |
| Example 6 | ZE | (c) | 31 |
| Example 7 | ZFE | (a) | 50 |
| Example 8 | ZFE | (b) | 1 |
| Example 9 | ZFE | (c) | 25 |

TABLE 3

CORROSION TEST RESULTS

| Test Number | Substrate | Post-Rinse Solution | Paint Creepage, Millimeters |
|---|---|---|---|
| Comparison 1 | CRS | Deionized Water | 9.6 |
| Example 1 | CRS | (a) | 8.8 |
| Example 2 | CRS | (b) | 3.1 |
| Example 3 | CRS | (c) | 4.2 |
| Comparison 2 | ZE | Deionized Water | 2.2 |
| Example 4 | ZE | (a) | 1.6 |
| Example 5 | ZE | (b) | 1.8 |
| Example 6 | ZE | (c) | 1.8 |
| Comparison 3 | ZFE | Deionized Water | 2.2 |
| Example 7 | ZFE | (a) | 1.3 |
| Example 8 | ZFE | (b) | 1.6 |
| Example 9 | ZFE | (c) | 1.1 |
| Comparison 4 | Al6111 | Deionized Water | 1.7 |
| Example 10 | Al6111 | (a) | 0.9 |
| Example 11 | Al6111 | (b) | 1.2 |
| Example 12 | Al6111 | (c) | 1.2 |

What is claimed is:

1. A process for chemical pretreatment, before an organic coating, of a composite metal structure that contains at least one aluminium or aluminium alloy portion together with at least one steel, galvanized steel or alloy-galvanized steel portion, said process comprising steps of:

I) treating in a first step the composite metal structure with a zinc phosphating solution, wherein the zinc phosphating solution has a free acid value of between 0 and 2.5 points and contains an amount of free fluoride, expressed in g/l, that is not greater than a quotient of the number 8 divided by the solution temperature in ° C. for a sufficient time to thereby form on steel and on galvanized and alloy-galvanized steel a surface-covering crystalline zinc phosphate layer having a coating weight in the range from 0.5 to 5 g/m$^2$, but without forming a surface-covering zinc phosphate layer on the aluminium portions;

and subsequently, with or without an intermediate rinsing with water, (II) contacting in a second step the composite metal structure with a treatment solution, comprising organic polymer, hexafluorotitanate and/or hexafluorozirconate ions, having a DH of 2.5–10 and a temperature in a range from 20 to 70° C. such that the treatment solution does not dissolve more than 60% of the crystalline zinc phosphate layer on steel, galvanized and/or alloy-galvanized steel, but does produce a conversion layer on the aluminum portions.

2. A process according to claim 1, wherein:

in step (I) the zinc phosphating solution has a pH in a range from 2.5 to 3.6 and a temperature in a range from 20 to 65° C. and contains an amount of free fluoride, expressed in g/l, that is not greater than a quotient of the number 8 divided by the solution temperature in ° C.;

from 0.3 to 3 g/l of Zn(II), from 5 to 40 g/l of phosphate ions, and at least one of the following amounts of the following types of accelerators:

0.3 to 4 g/l of chlorate ions, 0.01 to 0.2 g/l of nitrite ions, 0.05 to 2 g/l of m-nitrobenzenesulfonate ions, 0.05 to 2 g/l of m-nitrobenzoate ions, 0.05 to 2 g/l of p-nitrophenol, 0.001 to 0.15 g/l of hydrogen peroxide in free or bound form, 0.1 to 10 g/l hydroxylamine in free or bound form, and
0.1 to 10 of reducing sugar;

and optionally, one or more of the following
0.001 to 4 g/l of manganese (II)
0.001 to 4 g/l of nickel (II),
0.002 to 0.2 g/l of copper (II),
0.2 to 2.5 g/l of magnesium (II),
0.2 to 2.5 g/l of calcium (II),
0.01 to 0.5 g/l of iron (II),
0.2 to 1.5 g/l of lithium (I), and
0.02 to 0.8 g/l of tungsten (VI) and in step (II) the treatment solution does not dissolve more than 25% of the crystalline zinc phosphate layer deposited in step (I).

3. A process according to claim 2, wherein the treatment solution used in step (II) has a pH in the range from 3.5 to 5.5 and comprises from 0.3 to 1.5 g/l of hexafluorotitanate ions, hexafluorozirconate ions, or both.

4. A process according to claim 3, wherein the treatment solution used in step II) additionally comprises from 0.01 to 0.1 g/l of copper ions.

5. A process according to claim 2, wherein the treatment solution used in step (II) has a pH in the range from 3.3 to 5.8 and contains at lease one of: from 10 to 500 mg/l of organic polymers chosen from poly-4-vinylphenol molecules that conform to the immediately following general formula (I):

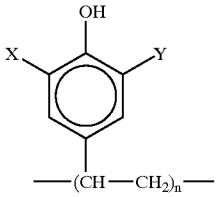

wherein n is a integer between 5 and 100, each of X and Y independently of each other denotes hydrogen or a $CRR^1OH$ moiety in which each of R and $R^1$ independently is hydrogen or an aliphatic or aromatic moiety with 1 to 12 carbon atoms;

from 10 to 5000 mg/l of organic polymers selected from materials (α) and (β), where:

(α) consists of polymer molecules each of which has at least one unit conforming to the immediately following general formula (II):

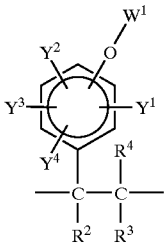

wherein:

each of $R^2$ to $R^4$ is selected, independently for each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, or an aryl moiety with from 6 to 18 carbon atoms;

each of $Y^1$ through $Y^4$ is selected, independently for each other and independently from one molecule of the component to another and from one to another unit of any polymer molecule conforming to this formula when there is more than one such unit in a single polymer molecule, except as noted further below, from the group consisting of: a hydrogen moiety; a $—CH_2Cl$ moiety; an alkyl moiety with from 1 to 18 carbon atoms; an aryl moiety with from 6 to 18 carbon atoms, a moiety conforming to the general formula $—CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

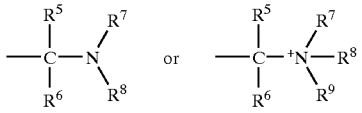

where each of $R^5$ through $R^8$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety, an aryl moiety, a hydroxyalkyl moiety, an aminoalkyl moiety, a mercaptoalkyl moiety, and a phosphoalkyl moiety and $R^9$ is selected from the group consisting of a hydrogen moiety, an alkyl moiety, an aryl moiety, a hydroxy or polyhydroxy alkyl moiety, an amino or polyaminoalkyl moiety, a mercapto or polymercapto alkyl moiety, a phosphor or polyphospho alkyl moiety, an $—O^-$ moiety, OH moiety, at least one $Y^1$ or $Y^4$ in at least one unit of each selected polymer molecule being a moiety Z as above defined; and $W^1$ is selected, independently from one molecule of the component to another and from one to another unit of any polymer molecule conforming to this formula when there is more than one such unit in a single polymer molecule, from the group consisting of a hydrogen moiety, an acryl moiety, an acetyl moiety, a benzoyl moiety, a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkyl-benzyl; halo or polyhalo alkyl; or halo or polyhalo alkenyl moiety, a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety; and (β) consists of polymer molecules each of which does not include a unit conforming to general formula (II) as given above but does include at least one unit corresponding to the immediately following general formula (III);

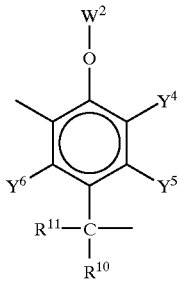

wherein:

$R^{10}$ and $R^{11}$ is selected, independently for each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^4$ through $Y^6$ is selected, independently of each other and independently from one molecule of the component to another and from one to another unit of any polymer molecule conforming to this formula when there is more than one such unit in a single polymer molecule, except as noted further below, from the group consisting of; a hydrogen moiety; a —$CH_2Cl$ moiety; an alkyl moiety with from 1 to 18 carbon atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z as defined for material (α) above, at least one of $Y^1$ through $Y^4$ in at lease one unit of each selected polymer molecule being a moiety Z as above defined; and $W_2$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety, a benzyl; methyl, ethyl, propyl, unsubstituted alkyl, unsubstituted alkyl, unsubstituted alkylbenzyl; halo or polyhalo alkyl, or halo or polyhalo alkenyl moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety; and from 250 to 1500 mg/l of organic polymers selected from the group consisting of homopolymers and copolymers of acrylic acid, methacrylic acid, and esters of acrylic and methacrylic acids, the phrase "polymer molecule" in the above definitions of materials (α) and (β) including any electrically neutral molecule with a molecular weight of at least 300 daltons.

6. A process according to claim 5, wherein the treatment solution used in step (II) comprises from 10 to 5000 mg/l of organic polymers selected from materials (α) and (β) and at least 20 number % of the moieties Z in material (α) and material (β) in the treatment solution used in step (II) of the process are polyhydroxyl moieties Z.

7. A process according to claim 5, wherein the treatment solution used in step (II) of the process comprises, as material (α), a condensation reaction produce of (i) polyvinyl phenol having a weight average molecular weight in a range from 1000 to 10,000 (ii) formaldehyde or paraformaldehyde and (iii) at least one secondary organic amine.

8. A process according to claim 7, wherein the secondary organic amine is selected from the group consisting of methylethanolamine, N-methylglucamine, and mixtures thereof.

9. A process according to claim 8, wherein the treatment solution has a pH in the range from 3.3 to 4.8, contains 100 to 5000 mg/l of the condensation reaction product, and in additionally comprises:

from 10 to 2000 mg/l of phosphate ions, from 10 to 2500 mg/l of hexafluorotitanate ions, hexafluorozirconate ions, or both; and from 10 to 1000 mg/l of manganese ions.

10. A process according to claim 1, wherein the treatment solution used in step (II) has a pH in a range from 3.5 to 5.5 and comprises from 0.3 to 1.5 g/l of hexafluorotitanate ions, hexafluorozirconate ions, or both.

11. A process according to claim 10, wherein the treatment solution used in step (II) additionally comprises from 0.01 to 0.1 g/l of copper ions.

12. A process according to claim 1, wherein the treatment solution used in step (II) has a pH in the range from 3.3 to 5.8 and contains at least one of: from 10 to 500 mg/l of organic polymers chosen from poly-4-vinylphenol molecules that conform to the immediately following general formula (I):

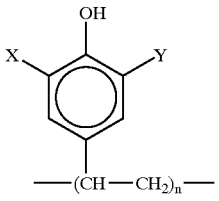

wherein n is an integer between 5 and 100, each of X and Y independently of each other denotes hydrogen or a $CRR^1OH$ moiety in which each of R and $R^1$ independently is hydrogen or an aliphatic or aromatic moiety with 1 to 12 carbon atoms;

from 10 to 5000 mg/l of organic polymers selected from materials (α) and (β), where:

(α) consists of polymer molecules each of which has at least one unit conforming to the immediately following general formula (II):

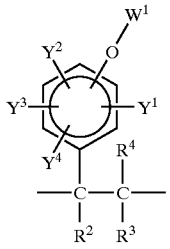

wherein:

each of $R^2$ through $R^4$ is selected, independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each $Y^1$ through $Y^4$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a —$CH_2Cl$ moiety; an alkyl moiety with from 1 to 18 carbon atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

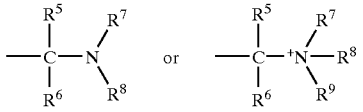

where each of $R^5$ through $R^8$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety, an aryl moiety, a hydroxyalkyl moiety, an aminoalkyl moiety, a mercaptoalkyl moiety, and a phosphoalkyl moiety and $R^9$ is selected from the group consisting of a hydrogen moiety, an alkyl moiety, an aryl moiety, a hydroxy or polyhydroxy alkyl moiety, an amino or polyaminoalkyl moiety, a mercapto or polymercapto alkyl moiety, a phospho or polyphospho alkyl moiety, an —$O^-$ moiety, and an —OH moiety, at least one $Y^1$ through $Y^4$ in at least one unit of each selected polymer molecule being a moiety Z as above defined; and W1 is selected, independently from one molecule of the component to another and from one to another unit or any polymer molecule conforming to this formula when there is more than one such unit in a single polymer molecule, from the group consisting of a hydrogen moiety, an acryl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety, a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkyphenyl-ethyl moiety; a benzyl, methyl, ethyl, propyl, unsubstituted alkyl, unsubstituted allyl, unsubstituted alkylbenzyl, halo or polyhalo alkyl, or halo or polyhalo alkenyl moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety; and (β) consists of polymer molecules each of which does not include a unit conforming to general formula (II) as given above but does include at least one unit corresponding to the immediately following general formula (III):

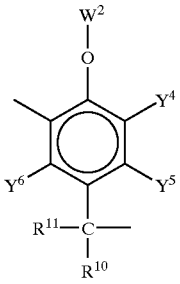

wherein:

each of $R^{10}$ and $R^{11}$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^4$ through $Y^6$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a —$CH_2C1$ moiety; an alkyl moiety with from 1 to 18 carbon atoms, an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z as defined for material (α) above, at least one of $Y^1$ through $Y^4$ in at least one unit of each selected polymer molecule being a moiety Z as above defined; and W2 is selected, independently from one molecule of the component to another and from one to another unit of any polymer molecule conforming to this formula when there is more than one such unit in a single polymer molecule, from the group consisting of a hydrogen moiety, an acryl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenyl-ethyl moiety; a benzyl, methyl, ethyl, propyl, unsubstituted alkyl, unsubstituted allyl, unsubstituted alkyl-benzyl; halo or polyhalo alkyl, or halo or polyhalo alkenyl moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety; and from 250 to 1500 mg/l of organic polymers selected form the group consisting of homopolymers and copolymers of acrylic acid, methacrylic acid, and esters of acrylic and methacrylic acids, the phrase "polymer molecule" in the above definitions of materials (α) and (β) including any electrically neutral molecule with a molecular weight of at least 300 daltons.

13. A process according to claim 12, wherein the treatment solution used in step (II) comprises from 10 to 5000 mg/l of organic polymers selected from materials (α) and (β) and at least 20 number % of the moieties Z in material (α) and material (β) in the treatment solution used in step (II) of the process are polyhydroxyl moieties Z.

14. A process according to claim 12, wherein the treatment solution used in step (II) of the process comprises, as material (α), a condensation reaction product of (i) polyvinyl phenol having a weight average molecular weight in a range from 1000 to 10,000, (ii) formaldehyde or paraformaldehyde, and (iii) at least one secondary organic amine.

15. A process according to claim 14, wherein the secondary organic amine is selected from the group consisting of methylethanolamine, N-methylglucamine, and mixtures thereof.

16. A process according to claim 15, wherein the treatment solution has a pH in the range from 3.3 to 4.8, contains 100 to 5000 mg/l of the condensation reaction product, and additionally comprises:

from 10 to 2000 mg/l of phosphate ions;

from 10 to 2500 mg/l of hexafluorotitanate ions, hexafluorozirconate ions, or both; and from 10 to 1000 mg/l of manganese ions.

17. A process according to claim 1, wherein the treatment solution used in step (II) has a pH In the range from 3.3 to 5.8 and contains from 10 to 5000 mg/l of organic polymers selected from materials (α) and (β), where:

(α) consists of polymer molecules each of which has at least one unit conforming to the immediately following general formula (II):

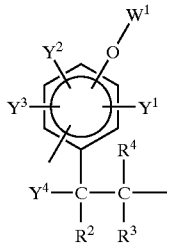

wherein:

each of $R^2$ through $R^4$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^1$ through $Y^4$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a $—CH_2Cl$ moiety; an alkyl moiety with from 1 to 18 carbon atoms; an aryl moiety with from 6 to 18 carbon atoms; a moiety conforming to the general formula $—CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

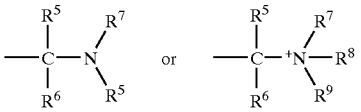

where each of $R^5$ through $R^8$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety, an aryl moiety, a hydroxyalkyl moiety, an aminoalkyl moiety, a mercaptoalkyl moiety, and a phosphoalkyl moiety and $R^9$ is selected from the group consisting of a hydrogen moiety, an alkyl moiety, an aryl moiety, a hydroxy or polyhydroxy alkyl moiety, an amino or polyaminoalkyl moiety, a mercapto or polymercapto alkyl moiety, a phospho or polyphospho alkyl moiety, an $—O^-$ moiety, an —OH moiety, at least one $Y^1$ through $Y^4$ in at least one unit of each selected polymer molecule being a moiety Z as above defined; and $W^1$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety, a 3-butoxy-2-hydroxypropyl moiety, a 3-alkyloxy-2-hydroxypropyl moiety; a 2-hydroxyoctyl moiety; a 2-hydroxyalkyl moiety, a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkylbenzyl; halo or polyhalo alkyl, or halo or polyhalo alkenyl moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety; and (β) consists of polymer molecules each of which does not include a unit conforming to general formula (II) as given above but does include at least one unit corresponding to the immediately following general formula (III):

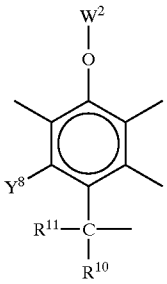

wherein:

each of $R^{10}$ and $R^{11}$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^4$ through $Y^6$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a —$CH_2Cl$ moiety; an alkyl moiety with from 1 to 18 carbon atoms, an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z as defined for material (α) above. At least one of $Y^1$ through $Y^4$ in at least one unit of each selected polymer molecule being a moiety Z as above defined; and $W^2$ is selected, independently from one molecule of the component to another and from one to another unit of any polymer molecule conforming to this formula when there is more than one such unit in a single polymer molecule, from the group consisting of a hydrogen moiety, an acryl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkyl-benzyl; halo or polyhalo alkyl, or halo or polyhalo alkenyl moiety; a moiety derived from a condensation polymerization product of ethylene oxide, propylene oxide or a mixture thereof by deleting one hydrogen atom therefrom; and a sodium, potassium, lithium, ammonium or substituted ammonium, or phosphonium or substituted phosphonium cation moiety; and At least 20 number % of the moieties Z in material (α) and (β) in the treatment solution used in step (II) of the process are polyhydroxyl moieties Z, the phrase "polymer molecule" in the above definitions of materials (α) and (β) including any electrically neutral molecule with a molecular weight of at least 300 daltons.

18. A process accordingly to claim 17, wherein the treatment solution used in step (II) of the process comprises, as material (α), a condensation reaction produce of (i) polyvinyl phenol having a weight average molecular weight in a range from 1000 to 10,000, (ii) formaldehyde or paraformaldehyde, and (iii) at least one secondary organic amine.

19. A process according to claim 18, wherein the secondary organic amine is selected from the group consisting of methylethanolamine, N-methylglucamine, and mixtures thereof.

20. A process according to claim 19, wherein the treatment solution has a pH in the range from 3.3 to 4.8, contains 100 to 5000 mg/l of the condensation reaction product, and additionally comprises:

from 10 to 2000 mg/l of phosphate ions;

from 20 to 2500 mg/l of hexafluorotitanate ions, hexafluorozirconate ions, or both; and from 10 to 1000 mg/l of manganese ions.

21. A process for chemical pretreatment, before an organic coating, of a composite metal structure that contains at least one aluminium or aluminium alloy portion together with at least one steel, galvanized steel or alloy-galvanized steel portion, said process comprising steps of:

I) treating in a first step the composite metal structure with a zinc phosphating solution having a free acid value of between 0 and 2.5 points and an amount of free fluoride, expressed in g/l, that is not greater than a quotient of the number 8 divided by the solution temperature in ° C., at a temperature in a range from 20 to 65° C. for a time sufficient to deposit on the steel, galvanized and alloy-galvanized steel portion, a surface-covering crystalline zinc phosphate layer and deposit on the aluminium portions only widely scattered zinc phosphate crystals;

and subsequently, with or without an intermediate rinsing with water,

II) contacting in a second step the composite metal structure with a treatment solution, comprising organic polymer, hexafluorotitanate and/or hexafluorozirconate ions, having a pH of 2.5–10 and a temperature in a range from 20 to 70° C. such that the treatment solution does not dissolve more than 60% of the crystalline zinc phosphate layer on steel, galvanized and/or alloy-galvanized steel, but does produce a conversion layer on the aluminum portions.

22. A process for chemical pretreatment, before an organic coating, of a composite metal structure that contains at least one aluminium or aluminium alloy portion together with at least one steel, galvanized steel or alloy-galvanized steel portion, said process comprising steps of:

I) treating in a first step the composite metal structure with a zinc phosphating solution, wherein the zinc phosphating solution has a pH in a range from 2.5 to 3.6 and a temperature in a range from 20 to 65° C. and contains an amount of free fluoride, expressed in g/l, that is not greater than a quotient of the number 8 divided by the solution temperature in ° C. thereby forming on steel and on galvanized and alloy-galvanized steel a surface-covering crystalline zinc phosphate layer having a coating weight in the range from 0.5 to 5 g/M2, but without forming a zinc phosphate layer on the aluminum portions;

and subsequently, with or without an intermediate rinsing with water,

II) contacting in a second step the composite metal structure with a treatment solution, comprising organic polymer, hexafluorotitanate and/or hexafluorozirconate ions, having a pH of 2.5–10 and a temperature in a range from 20 to 70° C. such that the treatment solution does not dissolve more than 60% of the crystalline zinc phosphate layer on steel, galvanized and/or alloy-galvanized steel, but does produce a conversion layer on the aluminum portions.

* * * * *

UNITED STATES PATENT AND TRADEMARK OFFICE

CERTIFICATE OF CORRECTION

PATENT NO. : 6,720,032 B1
DATED : April 13, 2004
INVENTOR(S) : Kuhm et al.

It is certified that error appears in the above-identified patent and that said Letters Patent is hereby corrected as shown below:

Column 14,
Line 45, delete "DH" and insert -- pH --.

Column 15,
Line 24, delete "lease" and insert -- least --.
Line 38, delete "a" and insert -- an --.

Column 17,
Line 45, delete "lease" and insert -- least --.
Line 46, delete "$W_2$" and insert -- $W^2$ --.
Line 60, delete "alkyl" and insert -- allyl --.

Column 18,
Line 28, delete "in".

Column 20,
Line 1, delete "W1" and insert -- $W^1$ --.

Column 21,
Line 1, delete "W2" and insert -- $W^2$ --.
Line 25, delete "form" and insert -- from --.
Line 61, delete "In" and insert -- in --.

Column 24,
Line 18, delete "At" and insert -- at --.

Signed and Sealed this

Twenty-fifth Day of April, 2006

JON W. DUDAS
*Director of the United States Patent and Trademark Office*